US008685602B2

(12) United States Patent
Ishihara et al.

(10) Patent No.: US 8,685,602 B2
(45) Date of Patent: Apr. 1, 2014

(54) TONER FOR ELECTROPHOTOGRAPHY, DEVELOPER FOR ELECTROPHOTOGRAPHY, TONER CARTRIDGE, IMAGE FORMING APPARATUS, AND IMAGE FORMING METHOD

(75) Inventors: Yuka Ishihara, Kanagawa (JP); Emi Takahashi, Kanagawa (JP); Masahiro Okita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 178 days.

(21) Appl. No.: 13/210,813

(22) Filed: Aug. 16, 2011

(65) Prior Publication Data

US 2012/0251935 A1 Oct. 4, 2012

(30) Foreign Application Priority Data

Mar. 28, 2011 (JP) ..... 2011-071239

(51) Int. Cl.
*G03G 9/08* (2006.01)

(52) U.S. Cl.
USPC ..... 430/108.6; 430/108.1; 430/111.4; 430/109.4; 430/123.5

(58) Field of Classification Search
USPC ..... 430/108.1, 109.4, 111.4, 108.6, 123.5
See application file for complete search history.

(56) References Cited

U.S. PATENT DOCUMENTS

| | | | | |
|---|---|---|---|---|
| 3,804,619 | A | 4/1974 | Mammino et al. | |
| 3,941,898 | A | 3/1976 | Sadamatsu et al. | |
| 4,386,147 | A | 5/1983 | Seimiya et al. | |
| 4,486,524 | A | 12/1984 | Fujisaki et al. | |
| 4,803,142 | A * | 2/1989 | Takagi et al. | 430/106.3 |
| 5,935,752 | A * | 8/1999 | Ueda et al. | 430/108.1 |

FOREIGN PATENT DOCUMENTS

| | | | | |
|---|---|---|---|---|
| JP | A-49-091231 | | 8/1974 | |
| JP | A-50-134652 | | 10/1975 | |
| JP | A-51-023354 | | 7/1976 | |
| JP | A-56-040868 | | 4/1981 | |
| JP | A-06-118684 | | 4/1994 | |
| JP | A-06-148928 | | 5/1994 | |
| JP | A-07-120973 | | 5/1995 | |
| JP | A-09-080797 | | 3/1997 | |
| JP | 2000081721 | A * | 3/2000 | G03G 9/08 |
| JP | A-2004-061813 | | 2/2004 | |
| JP | A-2004-061818 | | 2/2004 | |
| JP | A-2009-204788 | | 9/2009 | |

OTHER PUBLICATIONS

English language machine translation of JP 06-118684 (Apr. 1994).*
English language machine translation of JP 2000-081721 (Mar. 2000).*
Baumgaertel, M. et al. "Determination of discrete relaxation and retardation time spectra from dynamic mechanical data" Rheologica Acta 28, pp. 511-519 (1989).*

* cited by examiner

*Primary Examiner* — Christopher Rodee
(74) *Attorney, Agent, or Firm* — Oliff PLC

(57) ABSTRACT

There is provided a toner for electrophotography containing at least a binder resin, a colorant and a barium compound, and having a relaxation modulus G(t) of from about $2.0\times10^2$ Pa to about $3.0\times10^3$ Pa in a relaxation time of t=10×Dt (wherein Dt is the heating time taken during fixing) as determined by the measurement of dynamic viscoelasticity, and a barium content of from about 0.1% to about 0.5% with respect to the total amount of constituent atoms in the toner as determined by X-ray fluorescence.

14 Claims, No Drawings

TONER FOR ELECTROPHOTOGRAPHY, DEVELOPER FOR ELECTROPHOTOGRAPHY, TONER CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-071239 filed Mar. 28, 2011.

BACKGROUND

1. Technical Field

The present invention relates to a toner for electrophotography, a developer for electrophotography, a toner cartridge, an image forming apparatus, and an image forming method.

2. Related Art

Methods for visualizing image data by converting the image data into latent images (electrostatic latent mages), such as an electrophotography method, are currently used in a wide variety of fields. In the electrophotography method, an electrostatic latent image is formed on the surface of an electrophotographic photoreceptor (electrostatic latent image retaining member; hereinafter, may be referred to as "photoreceptor") through a charging step, an exposure step (latent image forming step) and the like, is developed using a toner for electrophotography (hereinafter, may be simply referred to as "toner"), and the electrostatic latent image is visualized through a transfer step, a fixing step and the like.

There has been suggested a method of reducing the irradiation of ultraviolet radiation by incorporating in advance a compound having an ultraviolet absorbing function into a toner together with other raw materials. Such a method is intended to suppress the effect of ultraviolet radiation on other materials in the toner, by making the compound having an ultraviolet absorbing function to absorb ultraviolet radiation, and converting the absorbed light energy into vibration energy in the molecules.

SUMMARY

According to an aspect of the invention, there is provided a toner for electrophotography containing a binder resin, a colorant, and a barium compound, the toner having a relaxation modulus G(t) of from $2.0\times10^2$ Pa to $3.0\times10^3$ Pa in a relaxation time of t=10×Dt (wherein Dt is the heating time taken during fixing) as determined by the measurement of dynamic viscoelasticity, and a barium content [Ba] of from 0.1% to 0.5% with respect to the total amount of constituent atoms in the toner as determined by X-ray fluorescence.

DETAILED DESCRIPTION

Hereinafter, exemplary embodiments of the toner for electrophotography, the developer for electrophotography, and the image forming method according to the invention will be described in detail.

[Toner for Electrophotography]

The toner for electrophotography according to the exemplary embodiment of the invention is a toner containing at least a binder resin, a colorant and a barium compound, and having a relaxation modulus G(t) of from $2.0\times10^2$ Pa to $3.0\times10^3$ Pa (or from about $2.0\times10^2$ Pa to about $3.0\times10^3$ Pa) in a relaxation time of t=10×Dt (wherein Dt is the heating time taken during fixing) as determined from the measurement of dynamic viscoelasticity, and a barium content [Ba] of from 0.1% to 0.5% (or from about 0.1% to about 0.5%) with respect to the total amount of constituent atoms in the toner as determined by X-ray fluorescence.

In recent years, image forming methods based on electrophotography using technologies involving toner and developer, have been gradually applied to the printing field along with the progress in digitalization and colorization, and has now been put to practical use to a remarkable extent in the label or packaging printing market, or in the graphic art market including on-demand printing. Here, the term graphic art market refers to the overall business market related to creative printing products with fewer copies printed with engravings or the like, imitation or duplication of the original copies of handwriting, painting and the like, or the printing production based on mass production systems called reproduction, and is defined as a market dealing with the field of businesses related to printing production.

However, when compared with the conventional formal printing mode, electrophotography has a feature of on-demand producibility as plateless printing. However, it may be seen that electrophotography still has numerous problems to be addressed in view of performance, such as image quality represented by the reproducible color gamut, resolution, gloss characteristics, texture, image quality uniformity within the same image, and maintainability of image quality during continuous printing for a long time, in order for the electrophotography technology to formally replace printing and to solicit a market value, particularly as a production material, in the field of graphic art.

One of the problems to be addressed in relation to the stability of images, may be cracking of fixed images due to long-term storage, or a decrease in the image gloss. Particularly, in the field of graphic art, the tendency for this cracking or a decrease in the image gloss is conspicuous in the case of photographs or paintings accompanied by color images where the image density (may be referred to as toner density) is high, or in the case of images on media that are highly likely to be routinely exposed to sunlight, such as food packaging materials, films, and stickers for which the market has recently been expanding. In food packaging materials, films and stickers, since conventional toner images are fixed on a white toner or coating material containing aluminum particles or titania particles, it is thought that the aluminum particles or titania particles in the white image on the base disturb the affinity with the conventional toner images, and embrittle the toner images more easily.

Furthermore, the occurrence of cracking of fixed images due to long-term storage or a decrease in the image gloss, is believed to be attributable to colorant molecules or binder resin absorbing ultraviolet radiation from sunlight and other illuminations, and the colorant molecules or the binder resin are degraded thereby. Also, for those resins used in conventional copying machines, since the benzene ring structure as a constituent element of the skeleton absorbs light in the shorter wavelength region, when exposed to ultraviolet radiation for a long time, the resins are embrittled, and the cracking of images or the decrease in the gloss level may become conspicuous.

In this exemplary embodiment, since a barium compound is incorporated into a toner particle showing specific viscoelasticity in a specific amount, the barium compound may be dispersed more uniformly, and cracking of the images or a decrease in the image gloss due to ultraviolet radiation may be prevented. Furthermore, by incorporating an ultraviolet absorbent into the toner particles, discoloration/decoloration of the colorant and embrittlement of images may be prevented more effectively.

The inventors of the present invention have found that when a small amount of a barium compound is incorporated into a toner for electrophotography showing a specific viscoelasticity, cracking of images, a decrease in the gloss level, or discoloration and decoloration of the colorant may be prevented. Furthermore, the inventors also have found that by incorporating an ultraviolet absorbent into the toner to which a barium compound has been added, decoloration of the colorant may be prevented more effectively.

Examples of the binder resin that is used in the current exemplary embodiment include polyester resins using an alkylene oxide adduct of bisphenol A used as an alcohol component, and styrene-acrylic resins. These binder resins are all characterized by having aromatic rings in the skeleton.

When there is a functional group having a property of easily donating electrons through conjugation, such as an aromatic ring, the energy level of the excited antibonding orbital is high, and the excited state becomes unstable. Therefore, this excited state causes degeneration of the skeleton in the binder resin, so that when exposed to light with high energy, such as ultraviolet radiation, the exposure brings about deterioration, and as a result, the resin is embrittled. Furthermore, when a functional group having an unshared pair of electrons, such as oxygen of an ester group, is present near an aromatic ring, the energy level of the antibonding orbital in which the unshared pair of electrons are present is further increased, and accordingly, the excited state becomes more unstable, causing the progress of deterioration.

As described above, a binder resin having an aromatic ring in the skeleton may undergo deterioration due to exposure to ultraviolet radiation, but when a barium compound is added to the toner, deterioration of the binder resin is suppressed.

(Presumed Operating Mechanism of Barium Compound)

The mechanism of suppressing deterioration of a binder resin by the addition of a barium compound has not yet been completely elucidated, but the mechanism may be explained as follows. Additionally, the authenticity of this mechanism is not intended to affect patentability.

First, there is a possibility that the barium compound acts as an ultraviolet absorbent for the aromatic ring molecules in an excited resin skeleton, and prevents embrittlement of the resin.

The light absorbed by the aromatic ring of the resin excites electrons, and the molecules enter into an electronically excited state. These molecules in the electrically excited state go through one, or two or more of (a) reaction, (b) deactivation (emission and non-emission process), and (c) energy transfer, which constitute the primary course of photochemistry, and return to the ground state.

In the case of a binder resin having an aromatic ring, the colorant molecules and the like in the toner come close and cause steric hindrance, and therefore, these molecules may interrupt the conversion of electronic excitation energy to vibration energy through the process of (b), so that the electronically excited state becomes more unstable. As a result, ionization of the molecules in the resin skeleton is likely to occur, and deterioration may occur, such as cleavage of the bonding state in the resin skeleton through the chemical reaction of (a).

In the exemplary embodiment of the invention, it is presumed that the barium compound contained in the toner receives excitation energy from the resin molecules in an excited state, and the outermost electrons of the barium element are excited ((c) above-described), and therefore, embrittlement of the resin may be prevented. Particularly, it is presumed that since molecules of the barium compound are smaller compared with the resin skeleton, the barium compound is hardly affected by steric hindrance, and the electronic excitation energy may be efficiently converted to vibration energy.

Furthermore, there is another possibility that the barium compound may act as a scavenger of excited oxygen molecules.

It is thought that singlet oxygen molecules that have been excited by light near the surface of the toner, are highly reactive and oxidize the neighboring resin, thereby embrittling the resin. It is presumed that when a barium compound which efficiently quenches these excited oxygen molecules is added, the excited oxygen molecules are deactivated, and embrittlement of the resin may be prevented.

As discussed above, it is speculated that since deterioration of the binder resin is suppressed by adding a barium compound to the toner, cracking of fixed images under exposure to ultraviolet radiation, or a decrease in the image gloss is suppressed in the toner of the exemplary embodiment of the invention.

In the toner of the exemplary embodiment of the invention, the relaxation modulus G(t) in a relaxation time of $t=10\times Dt$ (wherein Dt is the heating time during fixing) as determined by the measurement of dynamic viscoelasticity, is set in the range of from $2.0\times10^2$ Pa to $3.0\times10^3$ Pa (or from about $2.0\times10^2$ Pa to about $3.0\times10^3$ Pa). Preferably, it is appropriate to adjust the relaxation modulus to the range of from $2.3\times10^2$ Pa to $2.8\times10^3$ Pa (or from about $2.3\times10^2$ Pa to about $2.8\times10^3$ Pa).

If the relaxation modulus G(t) in the relaxation time described above is less than $2.0\times10^2$ Pa, it is difficult for the added barium compound to be uniformly dispersed, and also aggregatability of toner may not be sufficiently obtained. Thus, the low relaxation modulus becomes a factor by which the effect of preventing the embrittlement of images is decreased. Also, if the relaxation modulus is greater than $3.0\times10^3$ Pa, the gloss level of images is low, and adverse effects may be exerted on color developability.

The relaxation modulus and relaxation time according to the exemplary embodiment of the invention are determined from the dynamic viscoelasticity measured by a frequency dispersion analysis according to a sinusoidal oscillation method. For, the measurement of the dynamic viscoelasticity, an ARES analyzer manufactured by TA Instruments Japan, Inc. is used.

The relaxation modulus G(t) is calculated as follows.

The frequency dependent curves for loss modulus and storage modulus obtained by the measurement as described above are converted to a function with time on the horizontal axis and with the relaxation modulus on the vertical axis, according to the time-temperature superposition principle. Then, the curve (graph) in the lower right corner may be obtained. The relaxation time t is determined by the formula shown above, from an arbitrary fixing time (heating time during fixing) Dt, and the relaxation modulus at this t value on the curve is designated as the relaxation modulus at that fixing time.

Furthermore, adjustment of the relaxation modulus G(t) is carried out as follows.

That is, since the molecular weight distribution or the monomer composition of the binder resin contributes to a large extent as a factor controlling viscoelasticity, it is necessary to finely control the molecular weight distribution of the binder resin, or to select a specific monomer composition. Particularly, a desirable constitution of the molecular weight distribution has at least three peaks or shoulders, and when the molecular weight distribution is divided at the valley of the peaks or at the shoulder portions in order from the high molecular weight side, and the divided portions are designated as M1, M2 and M3, respectively, from the high molecular weight side, it is more desirable that the weight average molecular weight of M1 (Mw1) is from $5.0\times10^5$ to $7.2\times10^5$ (or from about $5.0\times10^5$ to about $7.2\times10^5$), the number average molecular weight of M1 (Mn1) is from $4.0\times10^5$ to $5.0\times10^5$ (or from about $4.0\times10^5$ to about $5.0\times10^5$); the weight average molecular weight of M2 (Mw2) is from $8.0\times10^4$ to $1.2\times10^5$ (or from about $8.0\times10^4$ to about $1.2\times10^5$), and the number average molecular weight of M2 (Mn2) is from $8.0\times10^4$ to $9.5\times10^4$ (or from about $8.0\times10^4$ to about $9.5\times10^4$); the weight average molecular weight of M3 (Mw3) is from $1.0\times10^4$ to $1.5\times10^4$ (or from about $1.0\times10^4$ to about $1.5\times10^4$), and the number average molecular weight of M3 (Mn3) is from 3500 to 4500 (or from about 3500 to about 4500).

(Barium Compound)

The toner of the exemplary embodiment of the invention contains a barium compound. Thereby, cracking of images, a decrease in the gloss level, or discoloration or decoloration of the colorant is suppressed.

The content of the barium compound may be from 0.1% to 0.5% (or from about 0.1% to about 0.5%) as a barium content [Ba] with respect to the total amount of constituent atoms of the toner as measured by X-ray fluorescence.

If the barium content is smaller than 0.1%, the effect of the barium content on the prevention of cracking of images or a decrease in the gloss level is not obtained, and if the content is larger than 0.5%, there is a risk that density unevenness may occur in the images and may have an adverse effect on the image quality. Therefore, the barium content needs to satisfy the range described above, and a content of from 0.12% to 0.45% (or from about 0.12% to about 0.45%) is desirable.

The barium compound that may be used in the exemplary embodiment may be any known inorganic barium compound, and for example, barium chloride, barium oxide, barium hydroxide, barium titanate, barium sulfate, barium carbonate, barium acetate, barium chromate, barium borate, barium ferrite, barium bromide, barium sulfite, and barium peroxide may be used. Furthermore, inorganic barium minerals such as zhangpeishanite (BaFCl), hyalophane ($BaAl_2Si_2O_8$), banalsite ($BaNa_2Al_4Si_4O_{16}$), and hokutolite (Ba, Pb)$SO_4$ may be added, and pigments such as nickel titan yellow (titanium nickel barium yellow) may also be added.

Among these, barium carbonate, barium titanate, barium sulfate, barium borate, and titanium nickel barium yellow are used more satisfactorily without exerting an adverse influence on the toner characteristics or the image forming apparatus, and more desirable barium contents are barium sulfate and barium titanate.

(Method for Producing Toner)

The toner for electrophotography of the exemplary embodiment of the invention has a binder resin, a colorant and a barium compound, and may further contain other components such as a release agent, as necessary. The toner for electrophotography of the exemplary embodiment of the invention may prevent, in color images, cracking of images or a decrease in the gloss level even under exposure to ultraviolet radiation for a long time, and the toner may produce excellent fixed images.

There are no particular limitations on the method for producing the toner for electrophotography of the exemplary embodiment, and examples include a kneading pulverization method, an emulsion aggregation method, and a suspension polymerization method. However, particularly desirable methods include a kneading pulverization method and an emulsion aggregation method.

According to the exemplary embodiment of the invention, it is desirable to disperse the barium compound uniformly in the toner, and it is necessary to disperse or dissolve the barium compound in the polymerizable monomer in the suspension polymerization method. However, polymerizable monomers in general are organic compounds, and there are occasions in which the barium compound is not dispersible or hardly soluble.

On the contrary, since the kneading pulverization method may mix the barium compound into a raw material mixture of a binder resin, a colorant and the like and may disperse the mixture directly in a kneading step, the barium compound may be uniformly dispersed. When the kneading product thus obtained is pulverized and classified, desired toner particles are obtained.

Furthermore, the emulsion aggregation method may address the problems described above, because the barium compound may be incorporated into a step of mixing a resin particle dispersion liquid in which resin particles of a binder resin having a particle size of 1 μm or less are dispersed, with a colorant dispersion liquid in which a colorant is dispersed, and the like, and causing the resin particles and the colorant to form aggregates having the toner particle size (hereinafter, may be referred to as "aggregation step"). When the barium compound is water-soluble, the barium compound may be added to the interior of the toner particles at a molecular level, and it is more desirable. When a carboxyl group-containing monomer is added to the polymerizable monomer components that constitute the resin particles, the carboxyl group and barium in the polymer thus produced may form a salt structure, and thus it is more desirable. The aggregated particles obtained from the aggregation step are subjected to a step of heating the aggregated particles to temperature equal to or higher than the glass transition temperature of the resin particles to coalesce the aggregates, and thus forming toner particles (hereinafter, also referred to as "coalescence step"), and are converted to toner particles.

In the aggregation step, the respective particles of the resin particle dispersion liquid, the colorant dispersion liquid, and if necessary, a release agent dispersion liquid that are mixed together, are aggregated, and thereby aggregate particles having the toner particle size are formed. The aggregate particles are formed by heteroaggregation or the like. For the purpose of stabilization of the aggregate particles, and control of the particle size/particle size distribution, an ionic surfactant having a polarity different from that of the aggregate particles, or a compound having monovalent or higher-valent charge, such as a metal salt, is added.

Here, the term "toner particle size" means the volume average particle size of the toner that will be described below.

In the coalescence step, the resin particles in the aggregated particles melt under the conditions of a temperature equal to or higher than the glass transition temperature of the resin particles, and the aggregated particles change into a more spherical shape from an irregular shape. At this time, since the barium compound present inside the aggregated particles remain within the particles irrespective of the progress of coalescence, the dispersed state of the barium compound may be satisfactorily controlled. It is needless to say that if a barium compound that forms a salt structure with carboxyl groups inside the aggregated particles is used, it is easier to control the dispersed state. Subsequently, the aggregates are separated from the aqueous medium and are washed and dried as necessary, and thereby toner particles are formed.

In regard to the volume average particle size of the toner, a volume average particle size of approximately from 2 μm to 10 μm is preferably used, and the volume average particle size is more preferably from 3 μm to 8 μm, and even more preferably from 5 μm to 7 μm.

(Binder Resin)

Examples of the binder resin that may be used in the toner of the exemplary embodiment of the invention include ethylene-based resins such as polyethylene and polypropylene; styrene-based resins containing polystyrene, poly(α-methylstyrene) and the like as main components; (meth)acrylic resins containing polymethyl methacrylate, polyacrylonitrile and the like as main components; polyamide resins, polycarbonate resins, polyether resins, polyester resins, and copolymer resins thereof. However, from the viewpoints of charging stability or development durability when the binder resin is used in the toner for electrophotography, styrene-based resins, (meth)acrylic resins, styrene-(meth)acrylic copolymer resins and polyester resins are desirable.

The condensable monomer used in the polyester resins is, for example, a condensable monomer component such as described in "Polymer Data Handbook: Fundamentals" (edited by The Society of Polymer Science, Japan; Baifukan Co., Ltd.), and examples include conventionally known divalent, or trivalent or higher-valent carboxylic acids and dihydric, or trihydric or higher-hydric alcohols. Specific examples of divalent carboxylic acids include dibasic acids such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, and mesaconic acid; anhydrides thereof; lower alkyl esters thereof; and aliphatic unsaturated dicarboxylic acids such as maleic acid, fumaric acid, itaconic acid, and citraconic acid. Examples of trivalent or higher-valent carboxylic acids include 1,2,4-benzenetricarboxylic acid, 1,2,5-benzenetricarboxylic acid, 1,2,4-naphthalenetricarboxylic acid; anhydrides thereof; and lower alkyl esters thereof. These may be used individually, or two or more kinds may be used in combination.

Examples of dihydric alcohols include bisphenol A, hydrogenated bisphenol A, ethylene oxide or (and) propylene oxide adduct(s) of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol, and neopentyl glycol. Examples of trihydric or higher-hydric alcohols include glycerin, trimethylolethane, trimethylolpropane, and pentaerythritol. These may be used individually, or two or more kinds may be used in combination. In addition, if necessary, a monovalent acid such as acetic acid or benzoic acid, or a monohydric alcohol such as cyclohexanol or benzyl alcohol may also be used for the purpose of adjusting the acid value or the hydroxyl group value.

The polyester resins described above may be synthesized from arbitrary combinations among the condensable monomer components described above, using those conventionally known methods described in, for example, "Polycondensation" (Kagaku Dojin Publishing Company, Inc., published in 1971), "Experimental Polymer Science (Polycondensation and Polyaddition)" (Kyoritsu Shuppan Co., Ltd., published in 1958), "Polyester Resin Handbook" (edited by Nikkan Kogyo Shimbun, Ltd., published in 1988), and the like. A transesterification method, a direct polycondensation method and the like may be used individually or in combination.

(Colorant)

According to the exemplary embodiment of the invention, there are no particular limitations on the colorant used, and known colorants may be selected according to the purpose. The colorants may be used individually, or mixtures of two or more kinds of colorants of the same type may be used. Furthermore, mixtures of two or more kinds of colorants of different types may also be used. These colorants may also be surface treated and used.

Specific examples of the colorant include pigments and dyes of various colors as shown below.

Representative examples include carbon black, aniline blue, calcoil blue, chrome yellow, ultramarine blue, Dupont Oil Red, quinoline yellow, methylene blue chloride, phthalocyanine blue, malachite green oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1, and C.I. Pigment Blue 15:3.

The colorant is preferably added in an amount in the range of from 4% by mass to 15% by mass, and more preferably added in an amount in the range of from 4% by mass and to 10% by mass, based on the total mass of the solids content of the toner, in order to secure color developability at the time of fixing. However, in the case of using a magnetic substance as a black colorant, the black colorant is preferably added in an amount ranging from 12% by mass to 48% by mass, and is more preferably in an amount ranging from 15% by mass to 40% by mass. By selecting the type of the colorant, toners of various colors such as a yellow toner, a magenta toner, a cyan toner, a black toner, a white toner, and a green toner are obtained.

[Ultraviolet Absorbent]

It is desirable that the toner of the exemplary embodiment of the invention contain an ultraviolet absorbent. For the ultraviolet absorbent used in the exemplary embodiment of the invention, conventionally known ultraviolet absorbents may be used.

Representative examples of the ultraviolet absorbent include benzophenone-based compounds, benzotriazole-based compounds, salicylic acid-based compounds, para-aminobenzoic acid-based compounds, anilide-based compounds, triazine-based compounds, and benzoate-based compounds. Mixtures of these compounds may also be used.

Specific examples of the ultraviolet absorbent include 2,4-dihydroxybenzophenone, 2-hydroxy-4-n-octyloxybenzophenone, 2-hydroxy-4-methoxybenzophenone, 2-hydroxy-4-methoxybenzophenone-5-sulfonic acid, sodium 2-hydroxy-4-methoxybenzophenone-5-sulfonate, 2-hydroxy-4-methoxy-2'-carboxybenzophenone, 4-benzyloxy-2-hydroxybenzophenone, 2,2'-dihydroxy-4,4'-dimethoxybenzophenone, 2,4-dihydroxybenzophenone, phenyl salicylate, 2-ethylhexyl salicylate, p-octylphenyl salicylate, p-tert-butylphenyl salicylate, para-aminobenzoic acid, glyceryl para-aminobenzoate, ethyl 2-cyano-3,3'-diphenylacrylate, 2-(2-hydroxy-5-methylphenyl)-2H-benzotriazole, 2-(3-tert-butyl-2-hydroxy-5-methylphenyl)-5-chloro-2H-benzotriazole, 1,6-bis(4-benzoyl-3-hydroxyphenoxy) hexane, 2-(5-methyl-2-hydroxyphenyl)benzotriazole, 2-[2-hydroxy-3,5-bis(α,α-dimethylbenzyl)phenyl]-2H-benzotriazole, 2-(3-t-butyl-5-methyl-2-hydroxyphenyl)-5-chlorobenzotriazole, 2-(2'-hydroxy-5'-t-octylphenyl) benzotriazole, 2-ethoxy-2'-ethyloxalic acid bisanilide, 2-(4',6-diphenyl-1,3,5-triazin-2-yl)-5-[(hexyl)oxy]phenol, and bis (1,2,2,6,6-pentamethyl-4-piperidyl) 2-(3,5-di-t-butyl-4-hydroxybenzyl)-2-n-butylmalonate. However, hydroxybenzophenone-based ultraviolet absorbents are particularly desirable. Although the mechanism is unclear, when a hydroxybenzophenone-based compound is internally added to the toner, the co-presence of the hydroxybenzophenone-based compound with a Ba compound results in an increase in the toner cohesive force, and an effect of increasing the image strength is anticipated.

The ultraviolet absorbent may be used individually, or two or more kinds may be used in combination. However, the type and amount of the ultraviolet absorbent may be regulated after taking the characteristics of the toner into consideration. For example, under the premise that powder fluidity, blocking during storage, chargeability and fixability should not cause any problem at the time of use of the toner, with respect to the toner composition, the ultraviolet absorbent is preferably used in an amount of from 0.1% by mass to 3.0% by mass when the ultraviolet absorbent is externally added to the mother toner particles, and is preferably used in an amount of from 0.3% by mass to 7.0% by mass when the ultraviolet absorbent is internally added at the time of preparation of the toner. When the amount added is in the range described above, chargeability and powder fluidity are not decreased. Furthermore, in order to make the ultraviolet absorbent uniformly dispersed in fixed images and to prevent the ultraviolet absorbent from exerting any effect on color developability, an ultraviolet absorbent having high affinity with binder resins is desirable. When the ultraviolet absorbent has high affinity, the ultraviolet absorbent does not crystallize within fixed images, and has a satisfactory light transmissibility.

Examples of a method of adding an ultraviolet absorbent to the toner include a method of mixing the ultraviolet absorbent in a powder form with toner particles, and a method of adding the ultraviolet absorbent during melt kneading of the binder resin or the colorant.

(Charge Controlling Agent)

The toner of the exemplary embodiment of the invention may contain a charge controlling agent, if necessary.

Conventionally known charge controlling agents may be used, but azo-based metal complex compounds, metal complex compounds of salicylic acid, and resin type charge controlling agents containing polar groups may be used. The toner of the exemplary embodiment of the invention may be any of a magnetic toner containing a magnetic material, and a non-magnetic toner which does not contain a magnetic material.

(Release Agent)

The toner of the exemplary embodiment of the invention may contain a release agent, if necessary. The release agent is generally used for the purpose of enhancing releasability. Specific examples of the release agent include low molecular weight polyolefins such as polyethylene, polypropylene, and polybutene; silicones having softening points by heating; fatty acid amides such as oleic acid amide, erucic acid amide, ricinolic acid amide, and stearic acid amide; plant waxes such as carnauba wax, rice wax, candelilla wax, wood wax, and jojoba oil; animal waxes such as beeswax; mineral/petroleum waxes such as montan wax, ozokerite, ceresin, paraffin wax, microcrystalline wax, and Fischer-Tropsch wax; ester-based waxes such as fatty acid esters, montanic acid esters, and carboxylic acid esters. In the exemplary embodiment of the invention, these release agents may be used individually, or two or more kinds may be used in combination.

The amount of these release agents added is preferably from 1% by mass to 20% by mass, and more preferably from 5% by mass to 15% by mass, based on the total amount of the toner particles. When the amount added is in the range described above, a sufficient effect of the release agent is obtained, the barium compound is uniformly dispersed in the toner, and the toner particles inside the developing machine are not easily destroyed. Therefore, the release agent is not spent to a carrier, and charging is not easily decreased.

(Internal Additive)

The toner of the exemplary embodiment of the invention may contain an internal additive within the toner. The internal additive is generally used for the purpose of controlling the viscoelasticity of fixed images. Specific examples of the internal additive include inorganic particles such as particles of silica and titania; and organic particles such as particles of polymethyl methacrylate, and the particles may be surface treated for the purpose of increasing dispersibility. Those particles may be used individually, or two or more internal additives may be used in combination.

(External Additive)

The toner of the exemplary embodiment of the invention may be treated by adding an external additive such as a fluidizing agent or a charge controlling agent. As the external additive, known materials such as inorganic particles such as silica particles having surfaces treated with a silane coupling agent, titanium oxide particles, alumina particles, cerium oxide particles, and carbon black; polymer particles such as particles of polycarbonate, polymethyl methacrylate, and silicone resins; amine metal salts, and salicylic metal complexes, may be used. Those external additives may be used individually, or two or more kinds of external additives may be used in combination.

The amount of the external additive to be incorporated is preferably from 0.1 part by mass to 5 parts by mass, and more preferably from 1.0 part by mass to 3.5 parts by mass, based on 100 parts by mass of the toner particles prior to the treatment with the external additive.

[Developer for Electrophotography]

The developer for electrophotography according to an exemplary embodiment contains at least the toner of the exemplary embodiment of the invention.

The toner of the exemplary embodiment of the invention is used in a developing apparatus by a method for use generally known as a single-component developer having a charge-giving structure, and is also used in a system called two-component developer which is composed of a toner and a carrier.

(Carrier)

The carrier is desirably a carrier having a core made of ferrite or iron powder and coated with a resin. The core material (carrier core material) used is not particularly limited, and examples include magnetic metals such as iron, steel, nickel and cobalt; magnetic oxides such as ferrite and magnetite; and glass beads. From the viewpoint of using a magnetic brush method, the carrier is desirably a magnetic carrier. The average particle size of the carrier core material is desirably from 3 times to 10 times the toner average particle size.

Examples of the coating resin include acrylic resins, styrene-based resins, amino resins such as urea, urethane, melamine, guanamine, and aniline; amide resins, and urethane resins. Copolymer resins of these resins may also be used. As the coating resin for carrier, a combination of two or more kinds of the resins described above may also be used. Also, for the purpose of controlling the charging process, resin particles, inorganic particles and the like may be dispersed in the coating resin to be used.

Examples of a method of forming a resin coating layer on the surface of a carrier core material, include a dipping method of dipping a powder of a carrier core material in a solution for coating layer formation; a spray method of spraying a solution for coating layer formation on the surface of a carrier core material; a fluidized bed method of spraying a solution for coating layer formation in a state in which a carrier core material is floated by fluidized air; a kneader coater method of mixing a carrier core material and a solution for coating layer formation in a kneader coater, and removing the solvent; and a powder coating method of granulating a coating resin, mixing the coating resin with a carrier core material in a kneader coater at or above the melting temperature of the coating resin, and cooling the mixture to coat the carrier core material with the mixture. However, a kneader coater method and a powder coating method are particularly desirably used.

The amount of resin coating formed by the method described above is considered to be from 0.5% by mass to 10% by mass based on the carrier core material. The mixing ratio (weight ratio) of the toner and the carrier is preferably in the range of toner:carrier=1:100 to 30:100, and more preferably in the range of 3:100 to 20:100.

[Toner Cartridge]

The toner cartridge of the exemplary embodiment of the invention includes a container accommodating the toner of the exemplary embodiment of the invention, and the toner cartridge is detachable from an image forming apparatus.

In the toner cartridge of the exemplary embodiment of the invention, the toner is accommodated in the container in an amount of for example 90% or more (or about 90% or more) by volume of the container.

[Image Forming Apparatus]

The image forming apparatus of the exemplary embodiment of the invention includes: an electrostatic latent image retaining member; a charging unit that charges the surface of the electrostatic latent image retaining member; an electrostatic latent image forming unit that forms an electrostatic latent image on the surface of the electrostatic latent image retaining member; a developing unit that holds the developer for electrophotography, and develops the electrostatic latent image formed on the surface of the electrostatic latent image retaining member, using the developer of the exemplary embodiment of the invention to form a toner image; a transfer unit that transfers the toner image onto a recording medium; and a fixing unit that fixes the toner image of the recording medium.

[Image Forming Method]

The image forming method of the exemplary embodiment of the invention includes a charging step of charging the surface of an electrostatic latent image retaining member, a latent image forming step of forming an electrostatic latent image on the surface of the charged electrostatic latent image retaining member, a developing step of holding a developer for electrophotography and developing the electrostatic latent image formed on the surface of the electrostatic latent image retaining member to form a toner image, a transfer step of transferring the toner image onto a recording medium, and a fixing step of fixing the toner image on the recording medium.

The respective steps are steps that are generally carried out per se, and are described in, for example, JP-A-56-40868, and JP-A-49-91231. The image forming method of the exemplary embodiment of the invention may be carried out using a known image forming apparatus such as a copying machine or a facsimile machine.

There are no particular limitations on the charging system in the charging step, and any of known non-contact charging systems based on a corotron and a scorotron, and contact charging systems may be used. However, a contact charging system which generates less ozone is desirable.

The latent image (electrostatic latent image) is formed by exposing a photoreceptor having the surface uniformly charged, to an exposure unit such as a laser optical system or an LED array. The exposure method is not particularly limited.

Transfer is a process of transferring a developed image (toner image) onto a body to be transferred. Examples of the body to be transferred include transfer paper.

Fixing is a process of fixing a toner image that has been transferred to a body to be transferred such as transfer paper, onto a body to be transferred through heating from fixing members, and the toner image on the body to be transferred is fixed by heating and melting during the passage of the body to be transferred between two fixing members. These fixing members are in the shape of a roller or a belt, and are equipped with a heating apparatus at least on one side. The fixing members use rollers or belts as received, or use them after coating the surfaces with a resin.

The term Dt (heating time during fixing) represents the contact time for the body to be transferred that will be described below, and the fixing members. Specifically, the fixing members are composed of a roller or a belt which is a heating member, and a pressing member. As the body to be transferred passes through between the heating member and the pressing member, fixing is achieved. The gap between this heating member and the pressing member is referred to as nip, and this nip typically has a width of several millimeters to several tens of millimeters in the direction of the passage of the body to be transferred. This gap is called nip width, and the time taken by the body to be transferred to pass through this nip width is referred to as heating time during fixing. For example, when the body to be transferred passes through a fixing machine having a nip width of 5 mm in a period of 100 mm/second, the heating time during fixing is 5/100=0.02, which is 20 milliseconds (also described as msec).

This nip width may be measured by, for example, the following method. First, a solid image is prepared with a conventional copying machine. While this solid image is passed through the fixing machine, the electric power is cut off, left cut off for 10 seconds, and then the solid image is passed again. Since the gloss level in the image areas that were in contact with the fixing members when the power supply was cut off, is different, this width is measured. This is defined as the nip width.

A method of providing a heat source in the pressing member, and applying heat from both of the pressing member and the heating member, may also be used.

The fixing roller is produced by coating the roller core material surface with a silicone rubber or Viton rubber.

The fixing belt is produced using polyamide, polyimide, polyethylene terephthalate, polybutylene terephthalate or the like, individually or as a mixture of two or more kinds. Examples of the coating resin for the roller and the belt include styrenes such as styrene, parachlorostyrene, and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls such as dimethylaminoethyl methacrylate; vinylnitriles such as acrylonitrile and methacrylonitrile; vinylpyridines such as 2-vinylpyridine and 4-vinylpyridine; vinyl ethers such as vinyl methyl ether, and vinyl isobutyl ether; vinyl ketones such as vinyl methyl ketone, vinyl ethyl ketone, and vinyl isopropenyl ketone; olefins such as ethylene and propylene; homopolymers or copolymers of two or more kinds of vinyl-based fluorine-containing monomers such as vinylidene fluoride, tetrafluoroethylene, and hexafluoroethylene; silicones such as methylsilicone and methylphenylsilicone; polyesters containing bisphenol and glycols; epoxy resins, polyurethane resins, polyamide resins, cellulose resins, polyether resins, and polycarbonate resins. These resins may be used individually, or two or more kinds may be used in combination. Specific examples that may be used include polytetrafluoroethylene, homopolymers of fluorine-containing compounds such as vinylidene fluoride and ethylene fluoride, and/or copolymers thereof, homopolymers of unsaturated hydrocarbons such as ethylene and propylene, and/or copolymers thereof.

For the body to be transferred onto which the toner is fixed, paper, a resin film, and the like are used. For the fixing paper, a coat paper produced by coating a portion or the entire surface of paper with a resin may be used. Also, as the resin film for fixing, resin-coated films in which the surface is coated partially or entirely by other kind of resin may be used. Furthermore, resin particles or inorganic particles may be added to a resin film or the like, for the purpose of preventing overlapped transport of the body to be transferred occurring due to the friction of paper, a resin film or the like, and/or due to the static electricity caused by friction, and of preventing a release agent from eluting out at the interface between the body to be transferred and the fixed image during fixing, and from deteriorating the adhesiveness of the fixed image.

Specific examples of the coating resin for paper and resin films include styrenes such as styrene, parachlorostyrene, and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls such as dimethylaminoethyl methacrylate; vinylnitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinyl methyl ketone, vinyl ethyl ketone, and vinyl isopropenyl ketone; olefins such as ethylene and propylene; homopolymers or copolymers composed of two or more kinds of vinyl-based fluorine-containing monomers such as vinylidene fluoride, tetrafluoroethylene, and hexafluoroethylene; silicones such as methylsilicone and methylphenylsilicone; polyesters containing bisphenol, glycols and the like; epoxy resins, polyurethane resins, polyamide resins, cellulose resins, polyether resins, and polycarbonate resins. These resins may be used individually, or two or more kinds may be used in combination.

Specific examples of inorganic particles that may be used include all particles that are conventionally used as external additives to modify the toner surface, such as particles of silica, titania, calcium carbonate, magnesium carbonate, tricalcium phosphate, and cerium oxide.

Examples of resin particles that may be used include all particles that are conventionally used as external additives to modify the toner surface, such as particles of vinyl-based resins, polyester resins, and silicone resins. These inorganic particles or resin particles may also be used as fluidizing aids, or the like.

EXAMPLES

Hereinafter, the exemplary embodiments of the invention will be described in more detail with reference to Examples and Comparative Examples, but the exemplary embodiments are not intended to be limited to the following Examples. Furthermore, unless particularly stated otherwise, the unit "parts" means "parts by mass", and the unit "percentage (%)" means "mass percent (mass %)".

(Measurement of Barium Content by X-Ray Fluorescence)

As a sample pretreatment, 4 g of a toner is pressed with a press molding machine for 1 minute under a load of 10 t.

X-ray fluorescence ZSX Primus 2 manufactured by Rigaku Corp. is used, and measurements are made under qualitative and quantitative measurement conditions, at a tube voltage of 60 kV and a tube current of 50 mA, for a measurement time of 40 deg/min.

(Measurement of Viscoelasticity of Toner)

An ARES analyzer manufactured by TA Instruments Japan, Inc. is used for the measurement of dynamic viscoelasticity.

Approximately 2 g of a toner is compression molded with a tableting machine, and then the tablet is mounted on a 25 mm parallel plate which has been heated in a heating furnace and is melted. When the toner is melted completely, another parallel plate is placed above the previous parallel plate, with the toner sample interposed between the plates. The normal force is set at zero, and then the viscoelasticity is measured at a plate temperature of 100° C., while sine vibration is generated at a vibration frequency of 0.1 rad/sec to 100 rad/sec. Subsequently, while the plate temperature is increased to 160° C. at an increment of 10° C., the same measurement is made. The interval of measurement is 30 seconds, and the accuracy of temperature regulation after the initiation of measurement is set to ±1.0° C. or less. Furthermore, the strain amount at the respective measurement temperatures is properly maintained and appropriately regulated during the measurement, so that appropriate measurement values can be obtained.

From the measurement results obtained at these respective measurement temperatures, the relaxation modulus is determined.

[Production of Toner Particles]

| (Preparation of polyester resin 1) | |
|---|---|
| Terephthalic acid | 415 parts |
| 3-Dodecenylsuccinic anhydride | 536 parts |
| Trimellitic anhydride | 90 parts |
| Ethylene oxide adduct of bisphenol A | 780 parts |
| Propylene oxide adduct of bisphenol A | 855 parts |

The raw materials described above are put into a four-necked round bottom flask having a capacity of 1 liter and equipped with a stirrer made of stainless steel, a nitrogen gas inlet tube made of glass, and a flow-down type condenser, and this flask is set up on a mantle heater. Subsequently, nitrogen gas is introduced through the gas inlet tube, and while the interior of the flask is maintained in an inert gas atmosphere, the temperature is increased. Thereafter, 0.15 part of dibutyltin oxide is added to the flask, and while the temperature of the reactants is maintained at 200° C., the reactants are allowed to react for a predetermined time. Thus, a polyester resin 1 is synthesized. The molecular weight distribution of the polyester resin 1 thus obtained is measured by gel permeation chromatography (GPC) using a tetrahydrofuran (THF)-soluble fraction, and the polyester resin 1 has a molecular weight distribution having three peaks including one shoulder. When the molecular weight distribution is divided at the respective valleys of the peaks or shoulder, and the molecular weights are designated as M1, M2 and M3 from the high molecular weight side, the weight average molecular weight Mw1 is $5.1\times10^5$, the number average molecular weight Mn1 is $4.3\times10^5$, the weight average molecular weight Mw2 is $9.4\times10^4$, the number average molecular weight Mn2 is 8.1×

$10^4$, the weight average molecular weight Mw3 of M3 is $1.2\times10^4$, and the number average molecular weight Mn3 is 3600.

| (Preparation of polyester resin 2) | |
|---|---|
| Terephthalic acid | 415 parts |
| Fumaric acid | 174 parts |
| 3-Dodecenylsuccinic anhydride | 268 parts |
| Ethylene oxide adduct of bisphenol A | 320 parts |
| Propylene oxide adduct of bisphenol A | 1370 parts |

A polyester resin 2 is synthesized in the same manner as in the preparation of the polyester resin 1, except that the raw materials of the resin are changed to the composition described above. The molecular weight distribution of the polyester resin thus obtained is measured by GPC, and the GPC chart shows a single peak distribution with a Mw of 17800 and a Mn of 6800.

| (Preparation of polyester resin 3) | |
|---|---|
| Terephthalic acid | 415 parts |
| 3-Dodecenylsuccinic anhydride | 268 parts |
| Trimellitic anhydride | 270 parts |
| Ethylene oxide adduct of bisphenol A | 780 parts |
| Propylene oxide adduct of bisphenol A | 855 parts |

A polyester resin 3 is synthesized in the same manner as in the preparation of the polyester resin 1, except that the raw materials of the resin are changed to the composition described above. The molecular weight distribution of the polyester resin 3 thus obtained is measured by GPC, and the GPC chart of the THF-soluble fraction shows a single peak distribution with a Mw of 53200 and a Mn of 14800. However, the proportion of the THF-insoluble fraction is 34%.

[Preparation of Cyan Toners (1) to (8)]

A polyester resin, C.I. Pigment Blue 15:3 (PB15:3) as a colorant, a release agent (polyethylene wax, FNP0190, manufactured by Nippon Seiro Co., Ltd.), an ultraviolet absorbent, and a barium compound are mixed in a Henschel mixer in the mixing amounts indicated in Table 1, and then the mixture is melt kneaded with a continuous type kneader. The kneading product is cooled and then is pulverized with a jet type pulverizer. Subsequently, the pulverization product is classified with a classifier of an inertial force system, and thus toner particles having the average particle size (toner particle size) indicated in Table 1 are obtained. 1.2 parts of titania particles and 0.8 part of silica particles are added as external additives to the toner particles thus obtained, based on 100 parts of the toner particles, and the mixture is mixed with a Henschel mixer. Thus, cyan toners for electrophotography are obtained.

[Preparation of Magenta Toners (1) to (10)]

A polyester resin, C.I. Pigment Red 122 (PR122) and Pigment Red 238 (PR238) as colorants, a release agent (polyethylene wax, FNP0190, manufactured by Nippon Seiro Co., Ltd.), an ultraviolet absorbent, and a barium compound are mixed in a Henschel mixer in the mixing amounts indicated in Table 1, and then the mixture is melt kneaded with a continuous type kneader. The kneading product is cooled and then is pulverized with a jet type pulverizer. Subsequently, the pulverization product is classified with a classifier of an inertial force system, and thus toner particles having the average particle size (toner particle size) indicated in Table 1 are obtained. 1.2 parts of titania particles and 0.8 part of silica particles are added as external additives to the toner particles thus obtained, based on 100 parts of the toner particles, and the mixture is mixed with a Henschel mixer. Thus, magenta toners for electrophotography are obtained.

[Preparation of Yellow Toners (1) to (8)]

A polyester resin, C.I. Pigment Yellow 74 (PY74) as a colorant, a release agent (polyethylene wax, FNP0190, manufactured by Nippon Seiro Co., Ltd.), an ultraviolet absorbent, and a barium compound are mixed in a Henschel mixer in the mixing amounts indicated in Table 1, and then the mixture is melt kneaded with a continuous type kneader. The kneading product is cooled and then is pulverized with a jet type pulverizer. Subsequently, the pulverization product is classified with a classifier of an inertial force system, and thus toner particles having the average particle size (toner particle size) indicated in Table 1 are obtained. 1.2 parts of titania particles and 0.8 part of silica particles are added as external additives to the toner particles thus obtained, based on 100 parts of the toner particles, and the mixture is mixed with a Henschel mixer. Thus, yellow toners for electrophotography are obtained.

[Preparation of Carrier]

1,000 parts of Mn—Mg ferrite (average particle size 50 μm; manufactured by PowderTech, Ltd.) is introduced into a kneader, and a solution obtained by dissolving 150 parts of a styrene-methyl methacrylate copolymer (polymerization ratio 40:60, glass transition temperature 90° C., weight average molecular weight 72,000; manufactured by Soken Chemical & Engineering Co., Ltd.) in 700 parts of toluene is added thereto. The resulting mixture is mixed at normal temperature (25° C.) for 20 minutes, and then is dried under reduced pressure by heating to 70° C. Subsequently, the product is taken out, and thus a coated carrier is obtained. The coated carrier thus obtained is subjected to sieving with a sieve having an opening size of 75 μm to remove coarse particles, and thus a carrier (1) is obtained.

[Preparation of Developer]

The carrier (1), and one of the yellow toners (1) to (8), the magenta toners (1) to (10), and the cyan toners (1) to (8) are introduced into a V-blender at a mass ratio of 95:5, and the mixture is stirred for 20 minutes. Thus, developers for electrophotography 1 to 26 are obtained. The types of the toners contained in the developers for electrophotography 1 to 26 are as indicated in Table 2.

[Formation of Fixed Image]

A developer for electrophotography thus obtained is filled into a developing machine of a modified machine of DocuCentre Color 320CP (manufactured by Fuji Xerox Co., Ltd.), and unfixed images of monochromatic images and the images of Test Chart No. 5-1 of the Imaging Society of Japan as original images are printed out. The paper is a product of Fuji Xerox Co., Ltd. (J paper).

Examples 1 to 15 and Comparative Examples 1 to 11

The unfixed images formed with the yellow toners (1) to (8), magenta toners (1) to (10), and cyan toners (1) to (8) are fixed at a fixing temperature of 160° C. using an off-line fixing machine which takes a fixing time (heating time during fixing) of 220 msec. In regard to the images thus obtained, the test chart images are evaluated by visually inspecting the density unevenness, and the monochromatic images are evaluated for cracking of images under long-term exposure to ultraviolet radiation, and for the gloss level. The results are shown in Table 3. The relaxation moduli for the respective toners at a fixing time of 220 msec and a fixing temperature of 160° C. are shown in Table 2.

Example 16 and Comparative Examples 12 to 14

Monochromatic and process black (three-color overlap) images are fixed on two kinds of fixing media such as shown below, using combinations of developers containing the toners indicated in Table 4, and the fixed images are evaluated for cracking of images under long-term exposure to ultraviolet radiation, and for the gloss level, in the same manner as in Examples 1 to 16 and Comparative Examples 1 to 10. The results are shown in Table 4.

Label paper for food packaging

Sticker paper coated with a white coating material containing titania particles at the surface

[Cracking of Images Under Long-Term Exposure to Ultraviolet Radiation]

The fixed images of Examples 1 to 16 and Comparative Examples 1 to 14 are subjected to an ultraviolet exposure acceleration test using a desktop exposure tester (manufactured by Toyo Seiki Seisaku-sho, Ltd.; SUNTEST CPS+). A xenon arc lamp (100 K Lux, 540 W/m$^2$) is used as a light source, and a fixed image is disposed at a distance of about 20 cm from the light source. Thus, an irradiation test is carried out in an environment of a humidity of 50%, and a surface temperature of a standard black body of 43° C. The humidity and the surface temperature of a standard black body fluctuate over a small range due to the environment of the tester or the like, and specifically, the humidity is 50±5%, while the surface temperature of the standard black body is 43±5° C. The irradiation time is 600 hours, 1200 hours, and 2400 hours, and cracking after irradiation is evaluated by visual inspection.

[Evaluation of Gloss Level]

In regard to the gloss level, the gloss level of an image is measured with a gloss meter. The gloss levels before ultraviolet irradiation and after ultraviolet irradiation are measured, and a comparison of the gloss levels before and after irradiation is made. The results are evaluated and rated based on the following criteria.

A: The difference between the gloss levels before and after irradiation is less than 5, which is an acceptable level.

B: The difference between the gloss levels before and after irradiation is equal to or greater than 5 and less than 12, which is an acceptable level.

C: The difference between the gloss levels before and after irradiation is equal to or greater than 12 and less than 20, and decreases in the gloss level and color developability are recognized.

D: The difference between the gloss levels before and after irradiation is equal to or greater than 20, and deterioration in the image is obvious.

The following facts are clearly understood from the results of Table 3. That is, when the toners of the exemplary embodiment of the invention are used, there is no occurrence of density unevenness, and images having appropriate gloss levels are provided. Also, documents which show excellent image preservability and do not show any cracking of images or a decrease in the gloss level even after long-term exposure to ultraviolet radiation, may be provided. Also, from the results of Table 4, it is confirmed that when the fixing material is other than ordinary paper, such as a label paper or a sticker paper, the toners of the exemplary embodiment of the invention exhibit excellent image preservability.

TABLE 1

| | Binder resin | | Colorant | | Barium compound | |
|---|---|---|---|---|---|---|
| Toner | Resin type | Amount added (parts) | Color material type | Amount added (parts) | Compound type | Amount added (parts) |
| Cyan toner-1 | Polyester resin 1 | 100 | PB15: 3 | 6 | Barium borate | 0.286 |
| Cyan toner-2 | Polyester resin 1 | 100 | PB15: 3 | 6 | Barium chloride | 0.187 |
| Cyan toner-3 | Polyester resin 1 | 100 | PB15: 3 | 6 | Barium carbonate | 0.288 |
| Cyan toner-4 | Polyester resin 1 | 100 | PB15: 3 | 6 | Barium chromate | 0.414 |
| Cyan toner-5 | Polyester resin 1 | 100 | PB15: 3 | 6 | Barium titanate | 0.97 |
| Cyan toner-6 | Polyester resin 1 | 100 | PB15: 3 | 6 | Barium sulfate | 0.426 |
| Cyan toner-7 | Polyester resin 2 | 100 | PB15: 3 | 6 | Barium sulfate | 0.41 |
| Cyan toner-8 | Polyester resin 3 | 100 | PB15: 3 | 6 | Barium titanate | 0.461 |
| Magenta toner-1 | Polyester resin 1 | 100 | PR122/PR238 | 4.5/4.5 | Zhangpeishanite fine powder | 0.172 |
| Magenta toner-2 | Polyester resin 1 | 100 | PR122/PR238 | 4.5/4.5 | Barium ferrite | 0.261 |
| Magenta toner-3 | Polyester resin 1 | 100 | PR122/PR238 | 4.5/4.5 | Barium borate | 0.232 |
| Magenta toner-4 | Polyester resin 1 | 100 | PR122/PR238 | 4.5/4.5 | Barium titanate | 0.581 |
| Magenta toner-5 | Polyester resin 1 | 100 | PR122/PR238 | 4.5/4.5 | Barium chromate | 0.399 |
| Magenta toner-6 | Polyester resin 2 | 100 | PR122/PR238 | 4.5/4.5 | Barium chromate | 0.466 |
| Magenta toner-7 | Polyester resin 3 | 100 | PR122/PR238 | 4.5/4.5 | Barium sulfate | 0.678 |
| Magenta toner-8 | Polyester resin 1 | 100 | PR122/PR238 | 4.5/4.5 | Barium sulfate | 0.194 |
| Magenta toner-9 | Polyester resin 1 | 100 | PR122/PR238 | 4.5/4.5 | Barium sulfate | 1.017 |
| Magenta toner-10 | Polyester resin 1 | 100 | PR122/PR238 | 4.5/4.5 | — | 0 |
| Yellow toner-1 | Polyester resin 1 | 100 | PY74 | 7 | Barium ferrite | 0.458 |
| Yellow toner-2 | Polyester resin 1 | 100 | PY74 | 7 | Barium carbonate | 0.207 |
| Yellow toner-3 | Polyester resin 1 | 100 | PY74 | 7 | Barium titanate | 0.95 |
| Yellow toner-4 | Polyester resin 2 | 100 | PY74 | 7 | Barium titanate | 0.679 |
| Yellow toner-5 | Polyester resin 1 | 100 | PY74 | 7 | Nickel titan yellow | 1.563 |
| Yellow toner-6 | Polyester resin 1 | 100 | PY74 | 7 | Barium sulfate | 0.914 |
| Yellow toner-7 | Polyester resin 1 | 100 | PY74 | 7 | Hyalophane fine powder | 0.455 |
| Yellow toner-8 | Polyester resin 3 | 100 | PY74 | 7 | Barium chromate | 0.489 |

TABLE 1-continued

| Toner | Release agent (PE wax) (parts) | Ultraviolet absorbent Compound type | Ultraviolet absorbent Amount added (parts) | Quantitative amount of Ba by X-ray fluorescence | Toner particle size (μm) |
|---|---|---|---|---|---|
| Cyan toner-1 | 9 | | | 0.153 | 6.8 |
| Cyan toner-2 | 9 | | | 0.098 | 7.2 |
| Cyan toner-3 | 9 | 2-Hydroxy-4-n-octyloxybenzophenone | 1.5 | 0.176 | 7.0 |
| Cyan toner-4 | 5 | | | 0.195 | 7.2 |
| Cyan toner-5 | 9 | | | 0.495 | 6.9 |
| Cyan toner-6 | 0 | | | 0.217 | 7.1 |
| Cyan toner-7 | 9 | | | 0.217 | 7.4 |
| Cyan toner-8 | 9 | | | 0.256 | 6.8 |
| Magenta toner-1 | 9 | | | 0.105 | 6.9 |
| Magenta toner-2 | 9 | | | 0.118 | 7.0 |
| Magenta toner-3 | 9 | | | 0.121 | 6.9 |
| Magenta toner-4 | 9 | | | 0.289 | 6.8 |
| Magenta toner-5 | 0 | 2-Hydroxy-4-n-octyloxybenzophenone | 1.5 | 0.183 | 7.2 |
| Magenta toner-6 | 9 | | | 0.231 | 7.4 |
| Magenta toner-7 | 9 | | | 0.365 | 7.3 |
| Magenta toner-8 | 9 | | | 0.097 | 6.9 |
| Magenta toner-9 | 9 | | | 0.506 | 7.2 |
| Magenta toner-10 | 9 | | | 0.000 | 7.0 |
| Yellow toner-1 | 9 | | | 0.210 | 6.8 |
| Yellow toner-2 | 9 | | | 0.124 | 6.7 |
| Yellow toner-3 | 5 | | | 0.498 | 6.9 |
| Yellow toner-4 | 5 | 2-Hydroxy-4-n-octyloxybenzophenone | 1 | 0.356 | 7.0 |
| Yellow toner-5 | 0 | 2-Hydroxy-4-n-octyloxybenzophenone | 1 | 0.102 | 7.3 |
| Yellow toner-6 | 0 | | | 0.502 | 7.4 |
| Yellow toner-7 | 9 | | | 0.156 | 7.0 |
| Yellow toner-8 | 9 | | | 0.190 | 6.8 |

TABLE 2

| | | Toner name | Barium compound type | Quantitative amount of barium (%) | Relaxation modulus at heating time during fixing of 220 msec and fixing temperature of 160° C. (Pa) |
|---|---|---|---|---|---|
| Example 1 | Developer 1 | Cyan toner-1 | Barium borate | 0.153 | $1.9 \times 10^3$ |
| Example 2 | Developer 2 | Cyan toner-3 | Barium carbonate | 0.176 | $1.7 \times 10^3$ |
| Example 3 | Developer 3 | Cyan toner-4 | Barium chromate | 0.195 | $1.8 \times 10^3$ |
| Example 4 | Developer 4 | Cyan toner-5 | Barium titanate | 0.495 | $1.9 \times 10^3$ |
| Example 5 | Developer 5 | Cyan toner-6 | Barium sulfate | 0.217 | $1.8 \times 10^3$ |
| Example 6 | Developer 6 | Magenta toner-1 | Zhangpeishanite fine powder | 0.105 | $1.5 \times 10^3$ |
| Example 7 | Developer 7 | Magenta toner-2 | Barium ferrite | 0.118 | $1.6 \times 10^3$ |
| Example 8 | Developer 8 | Magenta toner-3 | Barium borate | 0.121 | $2.1 \times 10^3$ |
| Example 9 | Developer 9 | Magenta toner-4 | Barium titanate | 0.289 | $2.0 \times 10^3$ |
| Example 10 | Developer 10 | Magenta toner-5 | Barium chromate | 0.183 | $1.9 \times 10^3$ |
| Example 11 | Developer 11 | Yellow toner-1 | Barium ferrite | 0.210 | $1.7 \times 10^3$ |
| Example 12 | Developer 12 | Yellow toner-2 | Barium carbonate | 0.124 | $1.6 \times 10^3$ |
| Example 13 | Developer 13 | Yellow toner-3 | Barium titanate | 0.498 | $2.1 \times 10^3$ |
| Example 14 | Developer 14 | Yellow toner-5 | Nickel titan yellow | 0.102 | $1.4 \times 10^3$ |
| Example 15 | Developer 15 | Yellow toner-7 | Hyalophane fine powder | 0.156 | $1.7 \times 10^3$ |
| Comp. Ex. 1 | Developer 16 | Cyan toner-2 | Barium chloride | 0.098 | $1.6 \times 10^3$ |
| Comp. Ex. 2 | Developer 17 | Cyan toner-7 | Barium sulfate | 0.217 | $1.9 \times 10^2$ |
| Comp. Ex. 3 | Developer 18 | Cyan toner-8 | Barium titanate | 0.256 | $3.1 \times 10^3$ |
| Comp. Ex. 4 | Developer 19 | Magenta toner-6 | Barium chromate | 0.231 | $1.8 \times 10^2$ |
| Comp. Ex. 5 | Developer 20 | Magenta toner-7 | Barium sulfate | 0.365 | $3.1 \times 10^3$ |
| Comp. Ex. 6 | Developer 21 | Magenta toner-8 | Barium sulfate | 0.097 | $2.0 \times 10^3$ |
| Comp. Ex. 7 | Developer 22 | Magenta toner-9 | Barium sulfate | 0.506 | $1.7 \times 10^3$ |
| Comp. Ex. 8 | Developer 23 | Magenta toner-10 | — | 0.000 | $1.6 \times 10^3$ |
| Comp. Ex. 9 | Developer 24 | Yellow toner-4 | Barium titanate | 0.356 | $1.8 \times 10^2$ |
| Comp. Ex. 10 | Developer 25 | Yellow toner-6 | Barium sulfate | 0.502 | $2.2 \times 10^3$ |
| Comp. Ex. 11 | Developer 26 | Yellow toner-8 | Barium chromate | 0.190 | $3.4 \times 10^3$ |

TABLE 3

| | Gloss level | | After 600 hours | | After 1200 hours | | After 2400 hours | |
|---|---|---|---|---|---|---|---|---|
| | before irradiation | Density unevenness | Cracking of images | Gloss level | Cracking of images | Gloss level | Cracking of images | Gloss level |
| Example 1 | 38 | No problem | No problem | A | No problem | A | Slight cracking occurs but at acceptable level | B |
| Example 2 | 42 | No problem | No problem | A | No problem | A | No problem | A |
| Example 3 | 40 | No problem | No problem | A | No problem | A | Slight cracking occurs but at acceptable level | B |
| Example 4 | 37 | No problem | No problem | A | No problem | A | Slight cracking occurs but at acceptable level | A |
| Example 5 | 39 | No problem | No problem | A | No problem | B | Slight cracking occurs but at acceptable level | B |
| Example 6 | 45 | No problem | No problem | A | Slight cracking occurs but at acceptable level | B | Slight cracking occurs but at acceptable level | B |
| Example 7 | 43 | No problem | No problem | A | No problem | A | Slight cracking occurs but at acceptable level | B |
| Example 8 | 36 | No problem | No problem | A | No problem | A | Slight cracking occurs but at acceptable level | B |
| Example 9 | 39 | No problem | No problem | A | No problem | A | Slight cracking occurs but at acceptable level | B |
| Example 10 | 36 | No problem | No problem | A | No problem | A | No problem | A |
| Example 11 | 41 | No problem | No problem | A | No problem | A | Slight cracking occurs but at acceptable level | B |
| Example 12 | 43 | No problem | No problem | A | No problem | A | Slight cracking occurs but at acceptable level | B |
| Example 13 | 36 | No problem | No problem | A | No problem | A | Slight cracking occurs but at acceptable level | B |
| Example 14 | 47 | No problem | No problem | A | No problem | A | Slight cracking occurs but at acceptable level | B |
| Example 15 | 42 | No problem | No problem | A | No problem | A | Slight cracking occurs but at acceptable level | A |
| Comp. Ex. 1 | 43 | No problem | Slight cracking occurs but at acceptable level | A | Cracking recognized | C | Images are embrittled and partially peeled off | C |
| Comp. Ex. 2 | 57 | No problem | Slight cracking occurs but at acceptable level | A | Cracking recognized | C | Images are embrittled and partially peeled off | C |
| Comp. Ex. 3 | 19 | No problem | No problem | A | No problem | A | Slight cracking occurs but at acceptable level | B |
| Comp. Ex. 4 | 61 | No problem | Cracking recognized | C | Cracking recognized | C | Images are embrittled and partially peeled off | D |
| Comp. Ex. 5 | 18 | No problem | No problem | A | No problem | A | Slight cracking occurs but at acceptable level | B |
| Comp. Ex. 6 | 39 | No problem | Slight cracking occurs but at acceptable level | A | Cracking recognized | C | Images are embrittled and partially peeled off | D |
| Comp. Ex. 7 | 40 | Conspicuous density unevenness | No problem | A | No problem | A | Slight cracking occurs but at acceptable level | B |
| Comp. Ex. 8 | 42 | No problem | Cracking recognized | C | Cracking recognized | D | Images are embrittled and partially peeled off | D |
| Comp. Ex. 9 | 62 | No problem | No problem | A | Cracking recognized | C | Images are embrittled and partially peeled off | D |
| Comp. Ex. 10 | 35 | Conspicuous density unevenness | No problem | A | No problem | A | Slight cracking occurs but at acceptable level | B |
| Comp. Ex. 11 | 17 | No problem | No problem | A | No problem | A | Slight cracking occurs but at acceptable level | B |

TABLE 4

| | | | | | Label paper for food packaging | | | | | |
|---|---|---|---|---|---|---|---|---|---|---|
| | | | | Gloss level | After 600 hours | | After 1200 hours | | After 2400 hours | |
| | C color | M color | Y color | before irradiation | Cracking of Images | Gloss level | Cracking of images | Gloss level | Cracking of images | Gloss level |
| Ex. 16 | Cyan toner-4 | Magenta toner-4 | Yellow toner-2 | 41 | No problem | A | No problem | A | Slight cracking occurs but at acceptable level | B |
| Comp. Ex. 12 | Cyan-toner 4 | Magenta toner-6 | Yellow toner-8 | 50 | No problem | A | Conspicuous cracking | C | Images are embrittled and partially peeled off | D |
| Comp. Ex. 13 | Cyan toner-2 | Magenta toner-4 | Yellow toner-6 | 40 | Slight cracking occurs but at acceptable level | B | Conspicuous cracking | C | Images are embrittled and partially peeled off | D |
| Comp. Ex. 14 | Cyan toner-7 | Magenta toner-7 | Yellow toner-8 | 26 | No problem | A | Conspicuous cracking | C | Images are embrittled and partially peeled off | D |

TABLE 4-continued

| | Sticker paper | | | | | |
|---|---|---|---|---|---|---|
| | After 600 hours | | After 1200 hours | | After 2400 hours | |
| | Cracking of images | Gloss level | Cracking of images | Gloss level | Cracking of images | Gloss level |
| Ex. 16 | No problem | A | No problem | A | Slight cracking occurs but at acceptable level | B |
| Comp. Ex. 12 | No problem | A | Conspicuous cracking | C | Images are embrittled and partially peeled off | D |
| Comp. Ex. 13 | No problem | A | Conspicuous cracking | C | Images are embrittled and partially peeled off | D |
| Comp. Ex. 14 | No problem | A | Conspicuous cracking | C | Images are embrittled and partially peeled off | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for electrophotography, comprising:

a binder resin, wherein a molecular weight distribution of the binder resin has at least three peaks or shoulders;

a colorant; and a barium compound, the toner having:

a relaxation modulus G(t) of from about $2.0\times10^2$ Pa to about $3.0\times10^3$ Pa at a fixing time of 220 msec and a fixing temperature of 160° C. as determined by a measurement of dynamic viscoelasticity;

a barium content of from about 0.1% to about 0.5% with respect to a total amount of constituent atoms in the toner as determined by X-ray fluorescence; and a colorant content of from 4% by mass to 15% by mass based on a total mass of the solids content of the toner.

2. The toner for electrophotography of claim 1, wherein the barium compound is selected from the group consisting of barium carbonate, barium titanate, barium sulfate, barium borate, and titan nickel barium yellow.

3. The toner for electrophotography of claim 1, wherein the barium content with respect to the total amount of constituent atoms in the toner as determined by X-ray fluorescence is from about 0.12% to about 0.45%.

4. The toner for electrophotography of claim 1, wherein the relaxation modulus G(t) of the toner is from about $2.3\times10^2$ Pa to about $2.8\times10^3$ Pa.

5. The toner for electrophotography of claim 1, wherein when the molecular weight distribution of the binder resin is divided at the valley of the peaks or at the shoulder portions in order from the high molecular weight side, and the divided portions are designated as M1, M2 and M3, respectively, from the high molecular weight side, a weight average molecular weight of M1 is from about $5.0\times10^5$ to about $7.2\times10^5$, and a number average molecular weight of M1 is from about $4.0\times10^5$ to about $5.0\times10^5$; a weight average molecular weight of M2 is from about $8.0\times10^4$ to about $1.2\times10^5$, and a number average molecular weight of M2 is from about $8.0\times10^4$ to about $9.5\times10^4$; a weight average molecular weight of M3 is from about $1.0\times10^4$ to about $1.5\times10^4$, and a number average molecular weight of M3 is from about 3500 to about 4500.

6. The toner for electrophotography of claim 1, further comprising an ultraviolet absorbent.

7. The toner for electrophotography of claim 6, wherein the ultraviolet absorbent is a hydroxybenzophenone-based ultraviolet absorbent.

8. A developer for electrophotography comprising the toner for electrophotography of claim 1 and a carrier.

9. The developer for electrophotography of claim 8, wherein the toner for electrophotography contains a barium compound selected from the group consisting of barium carbonate, barium titanate, barium sulfate, barium borate, and titan nickel barium yellow.

10. The developer for electrophotography of claim 8, wherein the relaxation modulus G(t) of the toner is from about $2.3\times10^2$ Pa to about $2.8\times10^3$ Pa.

11. A toner cartridge comprising a container accommodating the toner for electrophotography of claim 1, the toner cartridge being detachable from an image forming apparatus.

12. The toner cartridge of claim 11, wherein the toner for electrophotography is accommodated in the container in an amount of about 90% or more by volume of the container.

13. An image fowling method comprising:

charging a surface of an electrostatic latent image retaining member;

forming an electrostatic latent image on the surface of the charged electrostatic latent image retaining member;

developing the electrostatic latent image formed on the surface of the electrostatic latent image retaining member with the developer for electrophotography of claim 8 to form a toner image;

transferring the toner image onto a recording medium; and fixing the toner image on the recording medium.

14. The image forming method of claim 13, wherein the relaxation modulus G(t) of the toner is from about $2.3\times10^2$ Pa to about $2.8\times10^3$ Pa.

* * * * *